US005517080A

United States Patent [19]

Budzilek et al.

[11] Patent Number: 5,517,080

[45] **Date of Patent: * May 14, 1996**

[54] SUNLIGHT VIEWABLE THIN FILM ELECTROLUMINESCENT DISPLAY HAVING A GRADED LAYER OF LIGHT ABSORBING DARK MATERIAL

[75] Inventors: Russell A. Budzilek, Bridgeport; Dominic L. Monarchie, Norwalk, both of Conn.; Elliot Schlam, Wayside, N.J.; Richard R. Swatson, Trumbull, Conn.

[73] Assignee: Westinghouse Norden Systems Inc., Norwalk, Conn.

[ * ] Notice: The portion of the term of this patent subsequent to Dec. 16, 2012, has been disclaimed.

[21] Appl. No.: 989,672

[22] Filed: Dec. 14, 1992

[51] Int. Cl.[6] ..... H01J 1/62; G09G 3/10

[52] U.S. Cl. ..... 313/509; 313/503; 315/169.3; 428/917; 428/690

[58] Field of Search ..... 313/506, 509, 313/503; 315/169.3; 428/917, 690, 691

[56] References Cited

U.S. PATENT DOCUMENTS

| | | | |
|---|---|---|---|
| 3,560,784 | 2/1971 | Steele et al. | 313/92 |
| 4,066,925 | 1/1978 | Dickson | 313/509 |
| 4,287,449 | 9/1981 | Takeda et al. | 313/509 |
| 4,547,702 | 10/1985 | Schrank | 313/509 |
| 4,602,189 | 7/1986 | Panicker | 313/505 |
| 4,613,793 | 9/1986 | Panicker et al. | 315/169.3 |
| 4,719,152 | 1/1988 | Ohta et al. | 313/506 |
| 4,740,781 | 4/1988 | Brown | 340/712 |
| 4,758,765 | 7/1988 | Mitsumori | 313/506 |
| 4,963,788 | 10/1990 | King et al. | 313/503 |

OTHER PUBLICATIONS

J. Haaranen, R. Tornqvist, J. Koponen, T. Pitkanen, M. Surma–aho, W. Barrow, C. Laakso; *19.3: A 9–IN.–Diagonal High–Contrast Multicolor TFEL Display;* SID 92, Digest pp. 348–351.

*Primary Examiner*—Sandra L. O'Shea
*Assistant Examiner*—Matthew J. Esserman

[57] ABSTRACT

An AC thin film electroluminescent display panel includes a metal assist structure formed on and in electrical contact over each transparent electrode, and a graded layer of light absorbing dark material which combine to provide a sunlight viewable display panel.

20 Claims, 3 Drawing Sheets

FIG. 3
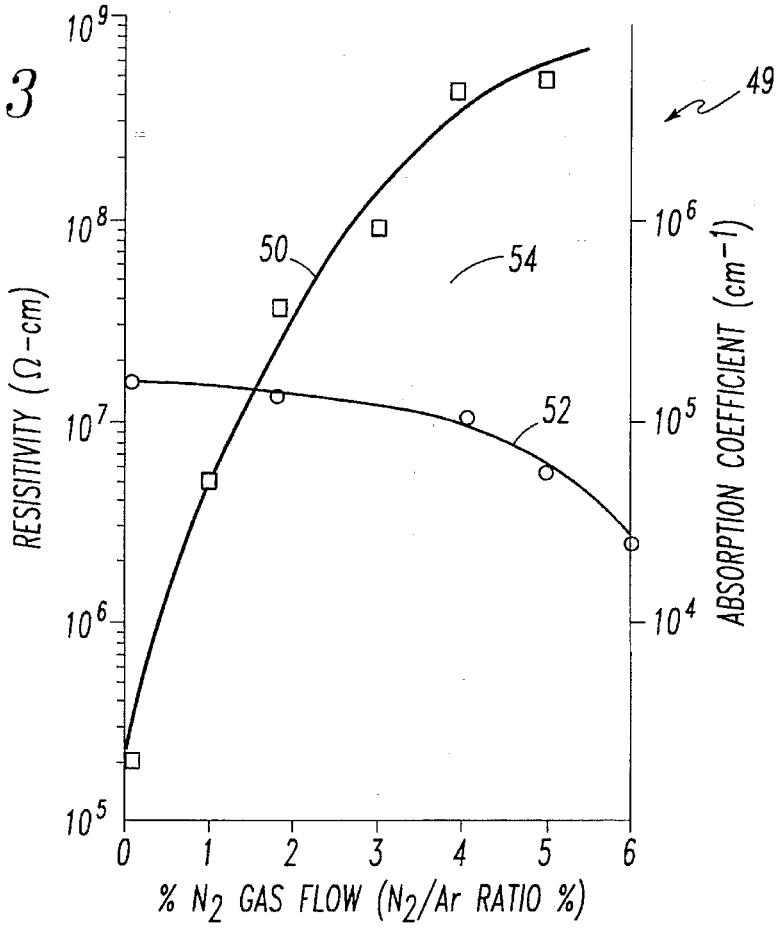
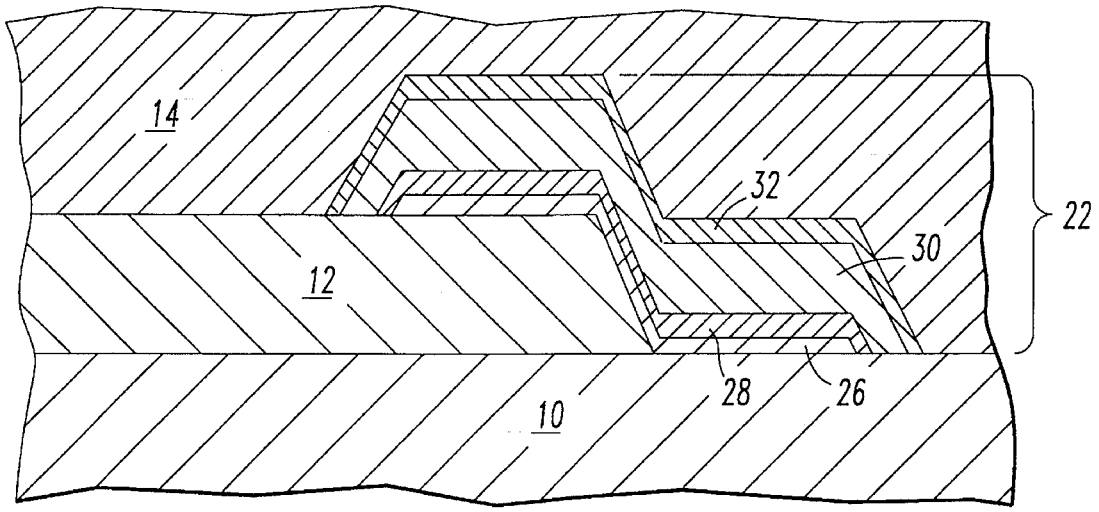
FIG. 4

SUNLIGHT VIEWABLE THIN FILM ELECTROLUMINESCENT DISPLAY HAVING A GRADED LAYER OF LIGHT ABSORBING DARK MATERIAL

CROSS REFERENCE TO RELATED APPLICATIONS

This application contains subject matter related to commonly assigned co-pending applications: Ser. No. 07/897,201, filed Jun. 11, 1992, entitled "Low Resistance, Thermally Stable Electrode Structure for Electroluminescent Displays"; Ser. No. 07/990,991, filed Dec. 16, 1992, now U.S. Pat. No. 5,445,898, entitled "Sunlight Viewable Thin Film Electroluminescent Display"; and Ser. No. 07/990,322, filed Dec. 14, 1992, now abandoned, entitled "Sunlight Viewable Thin Film Electroluminescent Display Having Darkened Metal Electrodes".

TECHNICAL FIELD

This invention relates to electroluminescent display panel and more particularly to reducing the reflection of ambient light to enhance the sunlight viewability of the panels.

BACKGROUND ART

Thin film electroluminescent (TFEL) display panels offer several advantages over older display technologies such as cathode ray tubes (CRTs) and liquid crystal displays (LCDs). Compared with CRTs, TFEL display panels require less power, provide a larger viewing angle, and are much thinner. Compared with LCDs, TFEL display panels have a larger viewing angle, do not require auxiliary lighting, and canhave a larger display area.

FIG. 1 shows a prior art TFEL display panel. The TFEL display has a glass panel 10, a plurality of transparent electrodes 12, a first layer of a dielectric 14, a phosphor layer 16, a second dielectric layer 18, and a plurality of metal electrodes 20 perpendicular to the transparent electrodes 12. The transparent electrodes 12 are typically indium-tin oxide (ITO) and the metal electrodes 20 are typically Al. The dielectric layers 14, 18 protect the phosphor layer 16 from excessive dc currents. When an electrical potential, such as about 200 V, is applied between the transparent electrodes 12 and the metal electrodes 20, electrons tunnel from one of the interfaces between the dielectric layers 14, 18 and the phosphor layer 16 into the phosphor layer where they are rapidly accelerated. The phosphor layer 16 typically comprises ZnS doped with Mno Electrons entering the phosphor layer 16 excite the Mn causing the Mn to emit photons. The photons pass through the first dielectric layer 14, the transparent electrodes 12, and the glass panel 10 to form a visible image.

Although current TFEL displays are satisfactory for some applications, more advanced applications require brighter higher contrast displays, larger displays, and sunlight viewable displays. One approach in attempt to provide adequate panel contrast under high ambient illumination is the use of a circular polarizer filter which reduces ambient reflected light. While this approach may provide reasonable contrast in moderate ambient lighting conditions, it also has a number of drawbacks which include a high cost and a maximum light transmission of about 37%.

DISCLOSURE OF THE INVENTION

An object of the present invention is to reduce the reflection of ambient light and enhance the contrast of a TFEL display to provide a sunlight viewable display.

Another object of the present invention is to provide a large TFEL display with enhanced contrast.

Yet another object of the present invention is to provide a high resolution TFEL panel with enhanced contrast.

According to the present invention, a graded layer of light absorbing dark material is included in the layered structure of a TFEL display panel having low resistance transparent electrodes.

The present invention provides a TFEL display panel which is comfortably viewable in direct sunlight. Another feature of the present invention is, by employing a graded layer of light absorbing dark material in a TFEL display having low resistance electrodes (which allow the display to be driven at a faster rate) larger display sizes such as those greater than thirty-six inches are now feasible.

These and other objects, features and advantages of the present invention will become more apparent in light of the following detailed description of a preferred embodiment thereof, as illustrated in the accompanying drawings.

BRIEF DESCRIPTION OF THE DRAWINGS

FIG. 3 is a graph of the graded dark layer absorption coefficient and resistivity as a function of the reactive gas flow ratio;

FIG. 4 is an enlarged cross-sectional view of a single ITO line and an associated metal assist structure of FIG. 2;

BEST MODE FOR CARRYING OUT THE INVENTION

In one embodiment, a graded layer of light absorbing dark material is included in an electroluminescent display panel to reduce the reflection of ambient light impinging on the display panel.

Figure 1:
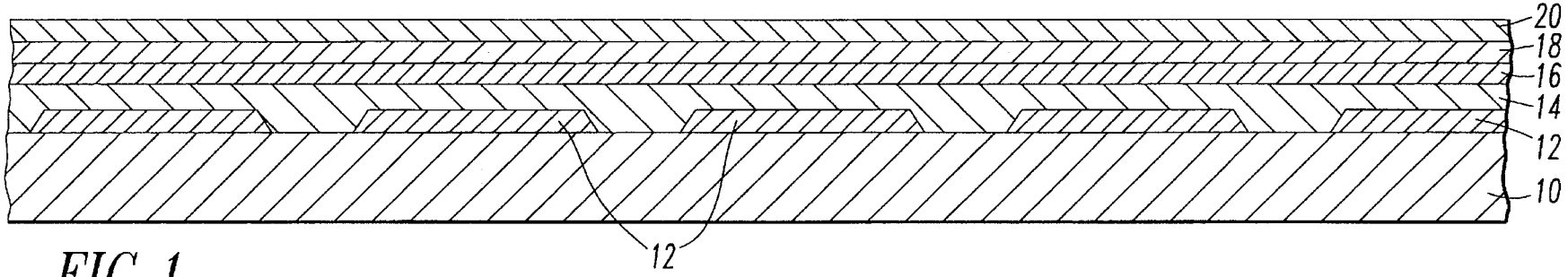
FIG. 1 PRIOR ART
FIG. 1 is a cross-sectional view of a prior art TFEL display.
Figure 2:
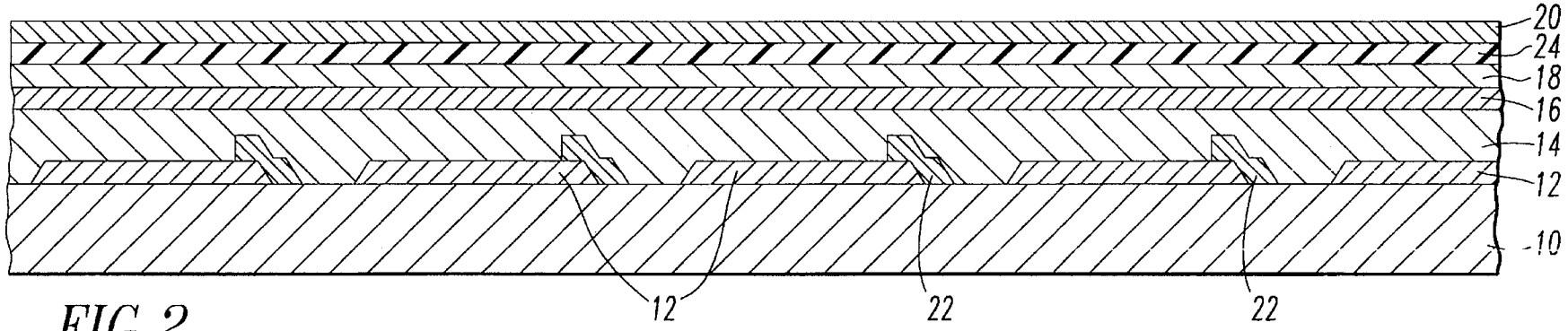
FIG. 2 is a cross-sectional view of a TFEL display having a graded layer of light absorbing dark material and low resistance transparent electrodes.

Referring to FIG. 2, a metal assist structure 22 is in electrical contact with a transparent electrode 12 and extends for the entire length of the electrode 12. The metal assist structure 22 can include one or more layers of an electrically conductive metal compatible with the transparent electrode 12 and other structures in the TFEL display panel. To decrease the amount of light transmissive area covered by the metal assist structure 22, the metal assist structure should cover only a small portion of the transparent electrode 12. For example, the metal assist structure 22 can cover about 10% or less of the transparent electrode 12. Therefore, for a typical transparent electrode 12 that is about 250 μm (10 mils) wide, the metal assist structure 22 should overlap the transparent electrode by about 25 μm (1 mil) or less. Overlaps as small as about 6 μm (0.25 mils) to about 13 μm (0.5 mils) are desirable. Although the metal assist structure 22 should overlap the transparent electrode 12 as little as possible, the metal assist structure should be as wide as practical to decrease electrical resistance. For example, a metal assist structure 22 that is about 50 μm (2 mils) to about 75 μm (3 mils) wide may be desirable. These two design parameters can be satisfied by allowing the metal assist structure 22 to overlap the glass panel 10 as well as the transparent electrode 12. With current fabrication methods, the thickness of the metal assist structure 22 should be equal to or less than the thickness of the first dielectric layer 16 to ensure that the first dielectric layer 16 adequately covers the transparent electrode 12 and metal assist structure. For example, the metal assist structure 22 can be less than about 250 nm thick. Preferably, the metal assist structure 22 will be less than about 200 nm thick, such as between about 150 nm and about 200 nm thick. However, as fabrication methods improve, it may become practical to make metal assist structures 22 thicker than the first dielectric layer 16.

The TFEL display panel also includes a graded layer of light absorbing dark material 24 to reduce the amount of ambient light reflected by the aluminum rear electrodes 20, and hence improve the display's contrast. The light absorbing layer 24 is a graded light absorbing layer and the material is a only a variation of the material used for the second dielectric layer 18 and not a unique material. The graded dark layer material is a nonstoichiometric silicon oxynitride ($SiO_xN_y$) which provides a high quality light absorbing layer, and can be produced rather easily by controlling the nitrogen/argon gas flow ratio during the standard dielectric deposition process. Alternatively, the graded light absorbing layer may be fabricated of other materials with like properties, such as, for example, GeN and $PrMnO_3$. FIG. 3 is a graph 49 of resistivity and absorption coefficient versus the reactive nitrogen/argon gas flow ratio. Resistivity is plotted along a line 50 and the absorption coefficient is plotted along a line 52. The graded layer should have a resistivity of at least $10^8$ ohms.cm, and a light absorption coefficient of about $10^5$/cm. These criteria place the nitrogen/argon gas flow ratio in a shaded region 54 representing about 3–4% $N_2$ gas flow. The thickness of the graded dark layer should be about 2000 angstroms. The graded layer of dark material 24 should also have a dielectric constant which is at least equal to or greater than the dielectric constant of the second dielectric 18, and preferably have a dielectric constant greater than seven.

Referring to FIG. 4, a preferred embodiment of the metal assist structure 22 is a sandwich of an adhesion layer 26, a first refractory metal layer 28, a primary conductor layer 30, and a second refractory metal layer 32. The adhesion layer 26 promotes the bonding of the metal assist structure 22 to the glass panel 10 and transparent electrode 12. It can include any electrically conductive metal or alloy that can bond to the glass panel 10, transparent electrode 12, and first refractory metal layer 28 without forming stresses that may cause the adhesion layer 26 or any of the other layers to peel away from these structures. Suitable metals include Cr, V, and Ti. Cr is preferred because it evaporates easily and provides good adhesion. Preferably, the adhesion layer 26 will be only as thick as needed to form a stable bond between the structures it contacts. For example, the adhesion layer 26 can be about 10 nm to about 20 nm thick. If the first refractory metal layer 28 can form stable, low stress bonds with the glass panel 10 and transparent electrode 12, the adhesion layer 26 may not be needed. In that case, the metal assist structure 22 can have only three layers: the two refractory metal layers 28, 32 and the primary conductor layer 30.

The refractory metal layers 28,32 protect the primary conductor layer 30 from oxidation and prevent the primary conductor layer from diffusing into the first dielectric layer 14 and phosphor layer 16 when the display is annealed to activate the phosphor layer as described below. Therefore, the refractory metal layers 28,32 should include a metal or alloy that is stable at the annealing temperature, can prevent oxygen from penetrating the primary conductor layer 30, and can prevent the primary conductor layer 30 from diffusing into the first dielectric layer 14 or the phosphor layer 16. Suitable metals include W, Mo, Ta, Rh, and Os. Both refractory metal layers 28,32 can be up to about 50 nm thick. Because the resistivity of the refractory layer can be higher than the resistivity of the primary conductor 30, the refractory layers 28, 32 should be as thin as possible to allow for the thickest possible primary conductor layer 30°. Preferably, the refractory metal layers 28, 32 will be about 20 nm to about 40 nm thick.

The primary conductor layer 30 conducts most of the current through the metal assist structure 22. It can be any highly conductive metal or alloy such as Al, Cu, Ag, or Au. Al is preferred because of its high conductivity, low cost, and compatibility with later processing. The primary conductor layer 30 should be as thick as possible to maximize the conductivity of the metal assist structure 22. Its thickness is limited by the total thickness of the metal assist structure 22 and the thicknesses of the other layers. For example, the primary conductor layer 30 can be up to about 200 nm thick. Preferably, the primary conductor layer 30 will be about 50 nm to about 180 nm thick.

The TFEL display of the present invention can be made by any method that forms the desired structures. The transparent electrodes 12, dielectric layers 14,18, phosphor layer 16 and metal electrodes 20 can be made with conventional methods known to those skilled in the art. The metal assist structure 22 can be made with an etch-back method, a lift-off method, or any other suitable method.

The first step in making a TFEL display like the one shown in FIG. 2 is to deposit a layer of a transparent conductor on a suitable glass panel 10. The glass panel can be any high temperature glass that can withstand the phosphor anneal step described below. For example, the glass panel can be a borosilicate glass such as Corning 7059 (Corning Glassworks, Corning, N.Y.). The transparent conductor can be any suitable material that is electrically conductive and has a sufficient optical transmittance for a desired application. For example, the transparent conductor can be ITO, a transition metal semiconductor that comprises about 10 mole percent In, is electrically conductive, and has an optical transmittance of about 85% at a thickness of about 200 nm. The transparent conductor can be any suitable thickness that completely covers the glass and provides the desired conductivity. Glass panels on which a suitable ITO layer has already been deposited can be purchased from Donnelly Corporation (Holland, Mich.). The remainder of the procedure for making a TFEL display of the present invention will be described in the context of using ITO for the transparent electrodes. One skilled in the art will recognize that the procedure for a different transparent conductor Would be similar.

ITO electrodes 12 can be formed in the ITO layer by a conventional etch-back method or any other suitable method. For example, parts of the ITO layer that will become the ITO electrodes 12 can be cleaned and covered with an etchant-resistant mask. The etchant-resistant mask can be made by applying a suitable photoresist chemical to the ITO layer, exposing the photoresist chemical to an appropriate wavelength of light, and developing the photoresist chemical. A photoresist chemical that contains 2-ethoxyethyl acetate, n-butyl acetate, xylene, and xylol as primary ingredients is compatible with the present invention. One such photoresist chemical is AZ 4210 Photoresist (Hoechst Celanese Corp., Somerville, N.J.). AZ Developer (Hoechst Celanese Corp., Somerville, N.J.) is a proprietary developer compatible with AZ 4210 Photoresist. Other commercially available photoresist chemicals and developers also may be compatible with the present invention. Unmasked parts of the ITO are removed with a suitable etchant to form channels in the ITO layer that define sides of the ITO electrodes 12. The etchant should be capable of removing unmasked ITO without damaging the masked ITO or glass under the unmasked ITO. A suitable ITO etchant can be made by mixing about 1000 ml $H_2O$, about 2000 ml HC1, and about 370 g anhydrous FeC13. This etchant is particularly effective when used at about 55° C. The time needed to remove the unmasked ITO depends on the thickness of the ITO layer. For example, a 300 nm thick layer of ITO can be removed in about 2 min. The sides of the ITO electrodes 12 should be chamfered, as shown in the Figures, to ensure that the first dielectric layer 14 can adequately cover the ITO electrodes. The size and spacing of the ITO electrodes 12 depend on the dimensions of the TFEL display. For example, a typical 12.7 cm (5 in) high by 17.8 cm (7 in) wide display can have ITO electrodes 12 that are about 30 nm thick, about 250 μm (10 mils) wide, and spaced about 125 μm (5 mils) apart. After etching, the etchantresistant mask is removed with a suitable stripper, such as one that contains tetramethylammonium hydroxide. AZ 400T Photoresist Stripper (Hoechst Celanese Corp.) is a commercially available product compatible with the AZ 4210 Photoresist. Other commercially available strippers also may be compatible with the present invention.

After forming ITO electrodes 12, layers of the metals that will form the metal assist structure are deposited over the ITO electrodes with any conventional technique capable of making layers of uniform composition and resistance. Suitable methods include sputtering and thermal evaporation. Preferably, all the metal layers will be deposited in a single run to promote adhesion by preventing oxidation or surface contamination of the metal interfaces. An electron beam evaporation machine, such as a Model VES-2550 (Airco Temescal, Berkeley, Calif.) or any comparable machine, that allows for three or more metal sources can be used. The metal layers should be deposited to the desired thickness over the entire surface of the panel in the order in which they are adjacent to the ITO.

The metal assist structures 22 can be formed in the metal layers with any suitable method, including etch-back. Parts of the metal layers that will become the metal assist structures 22 can be covered with an etchant-resistant mask made from a commercially available photoresist chemical by conventional techniques. The same procedures and chemicals used to mask the ITO can be used for the metal assist structures 22. Unmasked parts of the metal layers are removed with a series of etchants in the opposite order from which they were deposited. The etchants should be capable of removing a single, unmasked metal layer without damaging any other layer on the panel. A suitable W etchant can be made by mixing about 400 ml $H_2O$, about 5 ml of a 30 wt % $H_2O_2$ solution, about 3 g $KH_2PO_4$, and about 2 g KOH. This etchant, which is particularly effective at about 40° C., can remove about 40 nm of a W refractory metal layer in about 30 sec. A suitable Al etchant can be made by mixing about 25 ml $H_2O$, about 160 ml $H_3PO_4$, about 10 ml $HNO_3$, and about 6 ml $CH_3COOH$. This etchant, which is effective at room temperature, can remove about 120 nm of an Al primary conductor layer in about 3 min. A commercially available Cr etchant that contains $HClO_4$ and $Ce(NH_4)_2(NO_3)_6$ can be used for the Cr layer. CR-7 Photomask (Cyantek Corp., Fremont, Calif.) is one Cr etchant compatible with the present invention. This etchant is particularly effective at about 40° C. Other commercially-available Cr etchants also may be compatible with the present invention. As with the ITO electrodes 12, the sides of the metal assist structures 22 should be chamfered to ensure adequate step coverage.

The dielectric layers 14,18 and phosphor layer 16 can be deposited over the ITO lines 12 and metal assist structures 22 by any suitable conventional method, including sputtering or thermal evaporation. The two dielectric layers 14,18 can be any suitable thickness, such as about 80 nm to about 250 nm thick, and can comprise any dielectric capable of acting as a capacitor to protect the phosphor layer 16 from excessive currents. Preferably, the dielectric layers 14,18 will be about 200 nm thick and will comprise SiON. The phosphor layer 16 can be any conventional TFEL phosphor, such as ZnS doped with less than about 1% Mn, and can be any suitable thickness. Preferably, the phosphor layer 16 will be about 500 nm thick. After these layers are deposited, the display should be heated to about 500° C. for about 1 hour to anneal the phosphor. Annealing causes Mn atoms to migrate to Zn sites in the ZnS lattice from which they can emit photons when excited.

After annealing the phosphor layer 16, metal electrodes 20 are formed on the second dielectric layer 18 by any suitable method, including etch-back or lift-off. The metal electrodes 20 can. be made from any highly conductive metal, such as Al. As with the ITO electrodes 12, the size and spacing of the metal electrodes 20 depend on the dimensions of the display. For example, a typical 12.7 cm (5 in) high by 17.8 cm (7 in) wide TFEL display can have metal electrodes 20 that are about 100 nm thick, about 250 μm (10 mils) wide, and spaced about 125 μm (5 mils) apart. The metal electrodes 20 should be perpendicular to the ITO electrodes 12 to form a grid.

Figure 5:
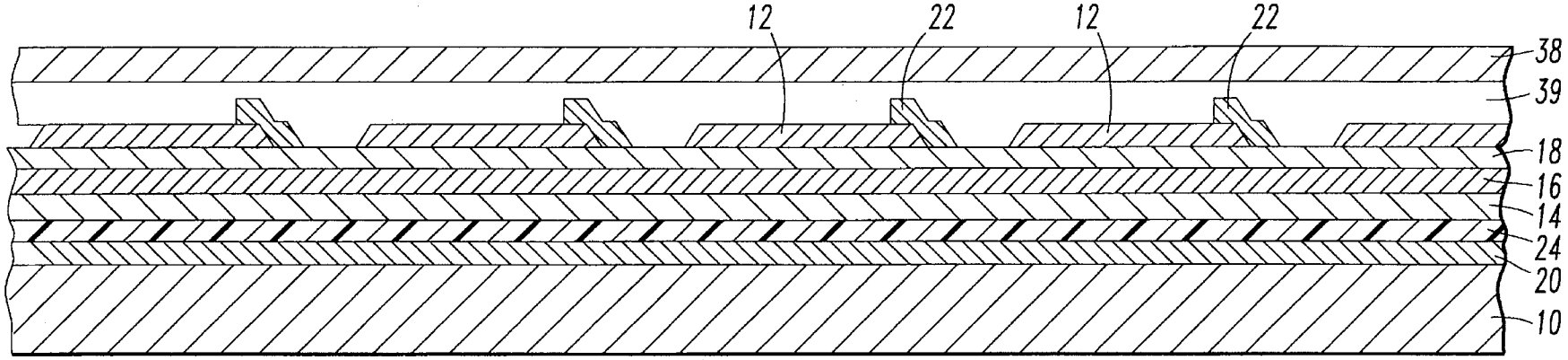
FIG. 5 is a cross-sectional view of an alternate embodiment TFEL display.

FIG. 5 shows an alternate embodiment. In this embodiment, the image is viewed from the colored filter 38 side of the display, rather than the glass panel 10 side. The colored filter 38 allows a multicolored image, rather than a monochrome image to be produced. This alternative embodiment places the Al electrodes 20 on the glass panel 10, the graded layer of light absorbing dark material 24 on the Al electrodes 20, followed by the layer of first dielectric material 14 to cover the layer of dark material 24. Phosphor layer 16 is placed between the layer of first dielectric material 14 and the layer of second dielectric material 18. A plurality of transparent electrodes 12 each incorporating the metal assist structure 22 illustrated in FIG. 4 are then placed on the layer of second dielectric material 18. A planarization layer 39 is placed over the non-covered portions of the second dielectric layer 18, the transparent electrodes 12, and the metal assist structures 22 to create a planar surface onto which the color filter 38 such as a glass plate with adjacent red and green stripes is disposed. The planarization layer 39 may include materials such as spun-on-glass, a transparent polymer material, or a liquid glass. A person skilled in the art will know how to modify the method of making a TFEL display described above to make a display like that shown in FIG. 5. For example, a person skilled in the art will know that the transparent electrodes 12 can be formed on the second dielectric layer 18 after the phosphor layer 16 is annealed.

Figure 6:
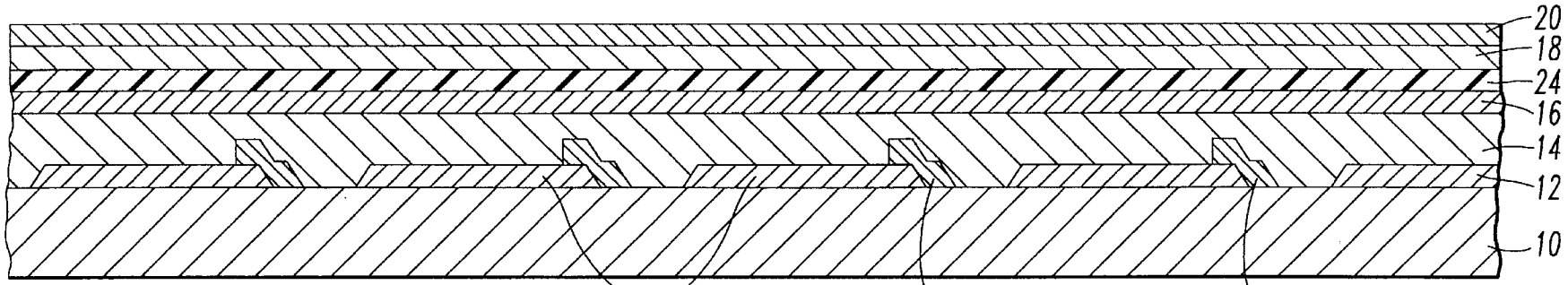
FIG. 6 is a cross-sectional view of yet another alternative embodiment.

FIG. 6 shows still another alternative embodiment of the present invention. The embodiment of FIG. 6 is similar to the embodiment of FIG. 2; the two embodiments differ primarily in that the position of the graded dark layer 24 and the second dielectric layer 18 are reversed. The remaining layers in the embodiment illustrated in FIG. 9 incorporate the same or substantially the same materials as the embodiment in FIG. 2.

In addition to the embodiments shown in FIGS. 2, 5, and 6, the TFEL display of the present invention can have any other configuration that would benefit from the combination of low resistance electrodes and light absorbing dark material, such as a graded layer of light absorbing dark material.

The present invention provides several benefits over the prior art. For example, the combination of low resistance electrodes and a graded layer of light absorbing dark material make TFEL displays of all sizes brighter. This makes large TFEL displays, such as a display about 91 cm (36 in) by 91 cm feasible since low resistance electrodes can provide enough current to all parts of the panel to provide even brightness across the entire panel, and the graded dark layer material reduces the reflection of ambient light to improve the panel's contrast. A display with low resistance electrodes and a dark layer can be critical in achieving sufficient contrast to provide a directly sunlight viewable thin film electroluminescent display.

Although the invention has been shown and described with respect to a preferred embodiment thereof, it should be understood by those skilled in the art that various other changes, omissions, and additions may be made to the embodiments disclosed herein, without departing from the spirit and scope of the present invention.

We claim:

1. A sunlight viewable electroluminescent display panel, comprising:

a glass substrate;

a plurality of parallel transparent electrodes deposited on said glass substrate, each of said transparent electrodes having a metal assist structure formed on, and in electrical contact over, a portion of said transparent electrodes;

a first dielectric layer deposited on said plurality of transparent electrodes;

a layer of phosphor material deposited on said first dielectric layer;

a second dielectric layer deposited on said layer of phosphor material;

a graded layer of light absorbing dark material, deposited on said second dielectric layer, for reducing reflected light; and a plurality of metal electrodes each deposited in parallel over said layer of light absorbing dark material.

2. The sunlight viewable electroluminescent display panel of claim 1, wherein each of said metal assist structures comprises a first refractory metal layer, a primary conductor layer formed on the first refractory layer, and a second refractory metal layer formed on the primary conductor layer such that the first and second refractory metal layers are capable of protecting the primary conductor payer from oxidation when the electroluminescent display is annealed to activate said phosphor layer.

3. The sunlight viewable electroluminescent display panel of claim 2 wherein said metal assist structure covers about 10% or less of said transparent electrode.

4. The sunlight viewable electroluminescent display panel of claim 2 wherein said layer of light absorbing dark material is $PrMnO_3$.

5. The sunlight viewable electroluminescent display panel of claim 1 wherein said layer of light absorbing dark material has a resistivity of least $10^8$ ohms/cm.

6. The sunlight viewable electroluminescent display panel of claim 1 wherein said layer of light absorbing dark material has a dielectric constant of at least seven.

7. The sunlight viewable electroluminescent display panel of claim 1 wherein said layer of light absorbing dark material has an absorption coefficient of about $10^5$/cm.

8. The sunlight viewable electroluminescent display panel of claim 1 wherein said layer of light absorbing dark material is GeN.

9. The sunlight viewable electroluminescent display panel of claim 2 wherein the edges of said metal assist structure are chamfered.

10. The sunlight viewable electroluminescent display panel of claim 9 wherein said graded layer of light absorbing dark material comprises a nonstoichiometric silicon oxynitride, $SiO_xN_y$.

11. The sunlight viewable electroluminescent display panel of claim 2, wherein said metal assist structure further comprises an adhesion layer formed between said first refractory metal layer and the transparent electrode, wherein said adhesion layer is capable of adhering to the transparent electrode and said first refractory metal layer.

12. The sunlight viewable electroluminescent display panel of claim 11 wherein said metal assist structure covers about 10% or less of said transparent electrode.

13. The sunlight viewable electroluminescent display panel of claim 12 wherein said layer of light absorbing dark material is $PrMnO_3$.

14. The sunlight viewable electroluminescent display panel of claim 13 wherein said layer of light absorbing dark material has a resistivity of least $10^8$ ohms/cm.

15. The sunlight viewable electroluminescent display panel of claim 14 wherein said layer of light absorbing dark material has a dielectric constant of at least seven.

16. The sunlight viewable electroluminescent display panel of claim 15 wherein said layer of light absorbing dark material has an absorption coefficient of about $10^5$/cm.

17. The sunlight viewable electroluminescent display panel of claim 16 wherein said layer of light absorbing dark material is GeN.

18. The sunlight viewable electroluminescent display panel of claim 17 wherein the edges of said metal assist structure are chamfered.

19. The sunlight viewable electroluminescent display panel of claim 18 wherein said graded layer of light absorbing dark material comprises a nonstoichiometric silicon oxynitride, $SiO_xN_y$.

20. An inverse viewable sunlight viewable electroluminescent display panel, comprising:

a glass substrate;

a plurality of metal electrodes each deposited in parallel over said glass substrate;

a graded layer of light absorbing dark material formed over each of said plurality of metal electrodes and exposed portions of said glass substrate;

a first dielectric layer deposited on said layer of light absorbing dark material;

a layer of phosphorus material deposited on said first dielectric layer;

a second dielectric layer deposited on said layer of phosphorus material;

a plurality of parallel transparent electrodes deposited on said second dielectric layer, each of said transparent electrodes having a metal assist structure formed on, and in electrical contact over, a portion of said transparent electrodes; and a planarization layer deposited on each of said plurality of parallel transparent electrodes and exposed portions of said second dielectric material to create a planar surface.

* * * * *